US009791198B2

(12) United States Patent
Jeong et al.

(10) Patent No.: US 9,791,198 B2
(45) Date of Patent: Oct. 17, 2017

(54) REFRIGERATOR

(71) Applicant: SAMSUNG ELECTRONICS CO., LTD., Suwon-si, Gyeonggi-do (KR)

(72) Inventors: Jin Jeong, Yongin-si (KR); Jae Seung Lee, Suwon-si (KR); Sung Cheol Kang, Gwangju (KR); Sang Hyun Park, Seongnam-Si (KR); Jae Koog An, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 364 days.

(21) Appl. No.: 13/927,677

(22) Filed: Jun. 26, 2013

(65) Prior Publication Data

US 2014/0000303 A1 Jan. 2, 2014

(30) Foreign Application Priority Data

Jun. 27, 2012 (KR) ..... 10-2012-0069078

(51) Int. Cl.
*F25C 5/18* (2006.01)
*F25C 5/00* (2006.01)
(Continued)

(52) U.S. Cl.
CPC ..... *F25C 5/007* (2013.01); *F25C 5/005* (2013.01); *F25D 23/069* (2013.01);
(Continued)

(58) Field of Classification Search
CPC ..... F25D 11/00; F25D 2303/081; F25D 2303/082; F25D 2303/083;
(Continued)

(56) References Cited

U.S. PATENT DOCUMENTS 490,511 A * 1/1893 Snyder ..... F25D 23/126 62/338
1,209,080 A * 12/1916 Tower ..... F25D 23/087 312/292
(Continued)

FOREIGN PATENT DOCUMENTS

CN 1648562 A 8/2005
CN 1811308 A 8/2006
(Continued)

OTHER PUBLICATIONS

Chinese Office Action dated Jun. 1, 2016 in corresponding Chinese Patent Application No. 201310384167.8.
(Continued)

*Primary Examiner* — Orlando E Aviles Bosques
(74) *Attorney, Agent, or Firm* — Staas & Halsey LLP

(57) ABSTRACT

A structure of an ice making compartment of a side by side type refrigerator to enhance ice making efficiency and to reduce energy consumption. The ice making compartment may be separately provided between a refrigerating compartment and a freezing compartment and be insulated from the refrigerating compartment and the freezing compartment. A portion of a refrigerant pipe is inserted into the inside of the ice making compartment so as to directly cool down the ice making compartment. A front opening of the ice making compartment can be closed by an ice bucket, and the ice bucket can be inserted into or drawn from the ice making compartment with being accessible without opening a refrigerating compartment door and a freezing compartment door.

12 Claims, 6 Drawing Sheets

(51) Int. Cl.
*F25D 23/06* (2006.01)
*F25D 17/06* (2006.01)

(52) U.S. Cl.
CPC ..... *F25D 17/065* (2013.01); *F25D 23/064* (2013.01); *F25D 2400/06* (2013.01)

(58) Field of Classification Search
CPC ..... F25D 2303/0831; F25D 2400/06; F25D 23/064; F25D 23/069; F25C 5/00
USPC ..... 62/344, 447, 458
See application file for complete search history.

(56) References Cited

U.S. PATENT DOCUMENTS 1,220,783 A * 3/1917 Ranney ..... F25D 23/126 62/338
1,979,638 A * 11/1934 Philipp ..... F25D 17/065 62/288
1,980,571 A * 11/1934 Brach ..... F25C 1/10 62/233
2,040,634 A * 5/1936 Sekyra ..... F25D 23/025 312/291
3,590,911 A * 7/1971 Horvay ..... F25D 17/065 165/263
4,209,999 A * 7/1980 Falk et al. ..... 62/344
4,583,376 A * 4/1986 Pritchard ..... F25D 11/02 62/382
5,177,980 A * 1/1993 Kawamoto ..... F25C 1/04 62/353
6,019,447 A * 2/2000 Jackovin ..... A47B 67/04 312/401
8,191,379 B2 * 6/2012 Wuesthoff et al. ..... 62/344
2004/0231353 A1 * 11/2004 Schuchart et al. ..... 62/337
2006/0162369 A1 * 7/2006 Chae ..... F25C 5/005 62/340
2006/0201189 A1 * 9/2006 Adamski et al. ..... 62/334
2007/0080102 A1 * 4/2007 Cur et al. ..... 210/235
2007/0151281 A1 * 7/2007 Jackovin ..... F25C 5/005 62/344
2008/0168794 A1 * 7/2008 Cho ..... F25D 23/025 62/441
2009/0229284 A1 * 9/2009 Fulton ..... F25C 5/005 62/137
2010/0072870 A1 * 3/2010 Hwang ..... F25D 23/025 312/405
2010/0218542 A1 * 9/2010 McCollough ..... F25C 5/005 62/345
2011/0030412 A1 * 2/2011 Kim ..... 62/391
2011/0048056 A1 * 3/2011 Ashrafzadeh et al. ..... 62/344
2011/0162405 A1 * 7/2011 Jeong ..... F25D 17/062 62/340
2012/0023998 A1 * 2/2012 Oh et al. ..... 62/340
2012/0031136 A1 * 2/2012 Park ..... F25D 11/02 62/340
2012/0043873 A1 * 2/2012 Jeon ..... F25D 23/028 312/405.1
2012/0210740 A1 * 8/2012 Kim ..... F25D 23/126 62/125

FOREIGN PATENT DOCUMENTS

CN 101592427 A 12/2009
CN 102261786 A 11/2011
JP 54-62561 5/1979
JP 3-118485 12/1991
KR 10-2005-0033295 4/2005
KR 10-2006-0074931 7/2006
KR 10-2010-0081038 7/2010
KR 10-2010-0116767 11/2010
KR 10-2011-0072435 6/2011
KR 10-2011-0080101 7/2011
KR 10-2012-0017483 2/2012

OTHER PUBLICATIONS

Korean Office Action dated Jun. 20, 2016 in corresponding Korean Patent Application No. 10-2012-0069078.
Korean Office Action dated Dec. 2, 2016 in corresponding Korean Patent Application No. 10-2012-0069078.
Korean Office Action dated Oct. 14, 2016 in corresponding Korean Patent Application No. 10-2012-0069078.
European Search Report dated Mar. 10, 2017 in corresponding European Patent Application No. 13174103.5.
Korean Office Action dated Feb. 24, 2017 in corresponding Korean Patent Application No. 10-2016-0181242.
Chinese Office Action dated Jan. 20, 2017 in corresponding Chinese Patent Application No. 201310384167.8.
Korean Office Action dated Jun. 12, 2017 in related Korean Application No. Oct. 2016-0181242.
Chinese Office Action dated May 22, 2017 in related Chinese Application No. 201310384167.8.
European Search Report dated Jul. 31, 2017 in related European Application No. 13174103.5.
Chinese Office Action dated Aug. 25, 2017 in related Chinese Application No. 201310384167.8.

* cited by examiner

REFRIGERATOR

CROSS-REFERENCE TO RELATED APPLICATIONS

This application claims the priority benefit of Korean Patent Application No. 10-2012-0069078, filed on Jun. 27, 2012 in the Korean Intellectual Property Office, the disclosure of which is incorporated herein by reference.

BACKGROUND

1. Field

The following description relates to a refrigerator having an ice making compartment and a water dispensing system.

2. Description of the Related Art

In general, a refrigerator is an apparatus configured to store foods fresh by having a storage compartment for storing foods and a cooling energy supplying device for supplying a cooling energy to the storage compartment. A refrigerator may be provided with an ice maker for generating ice.

For example, in a case of a side by side type refrigerator which has a refrigerating compartment and a freezing compartment on right and left sides inside a body of the refrigerator, respectively, an ice maker may be provided inside the freezing compartment. The ice maker generates ice with a cooling energy inside the freezing compartment.

However, in order to make ice in a side by side type refrigerator of this structure, the whole area inside a freezing compartment should be cooled down below freezing temperatures so that time and energy are inefficiently consumed.

Further, since a freezing compartment is closed by a freezing compartment door which is rotatably connected to a body of a refrigerator, the freezing compartment door should be opened in order to extract the ice inside the freezing compartment. Once the freezing compartment door is opened, the cooling energy inside the freezing compartment is easily discharged to an outside because the whole open front portion of the freezing compartment is exposed to the outside.

Additionally, the above-noted problem may occur in other types of refrigerators where an ice making compartment is provided in a refrigerating compartment and an ice maker inside the ice making compartment generates ice using other sources of cooling energy rather than a cooling air inside the refrigerating compartment, since the refrigerating compartment door is opened in order to extract the ice inside the ice making compartment of the refrigerating compartment, resulting in leakage of the cooling energy inside the refrigerating compartment.

SUMMARY

The present disclosure relates to a structure of a side by side type refrigerator which makes ice rapidly.

The present disclosure also relates to a structure of a side by side type refrigerator which minimizes a leakage of a cooling energy inside the refrigerator when an ice bucket is inserted into or drawn from the refrigerator.

The present disclosure further relates to a structure of a side by side type refrigerator with an ice maker and a dispenser which has a simplified water supplying pipe and a water supplying system with enhanced reliability.

Additional aspects and/or advantages will be set forth in part in the description which follows and, in part, will be apparent from the description, or may be learned by practice of the invention.

In accordance with one aspect of the present disclosure, a refrigerator includes a body; a freezing compartment formed inside the body and having an open front portion; a refrigerating compartment formed inside the body and having an open front portion; a freezing compartment door rotatably connected to the body and closing the open front portion of the freezing compartment; a refrigerating compartment door rotatably connected to the body and closing the open front portion of the refrigerating compartment; and an ice making compartment formed between the freezing compartment and the refrigerating compartment inside the body and being accessible without opening the freezing compartment door and the refrigerating compartment door.

The refrigerator may further include a first intermediate insulation wall which insulates the ice making compartment from the freezing compartment and a second intermediate insulation wall which insulates the ice making compartment from the refrigerating compartment.

Also, the refrigerator may further include a front insulation wall which is formed in front of the ice making compartment and which insulates the ice making compartment.

The front insulation wall may have an opening through which an ice bucket storing ice is inserted into or drawn from the ice making compartment.

The ice bucket may have an insulation cover which closes the opening.

The insulation cover may have corresponding thickness to the front insulation wall.

The ice bucket may be able to be inserted into or drawn from the ice making compartment without opening the freezing compartment door and the refrigerating compartment door.

Further, a front surface of the front insulation wall may be provided with a control panel which displays operation information of the refrigerator and receives operation commands to the refrigerator.

Meanwhile, the refrigerator may further include a cooling energy supplying device having a compressor, a condenser, a capillary tube, an evaporator, and a refrigerant pipe, and at least a portion of the refrigerant pipe is inserted into the inside of the ice making compartment to directly cool the ice making compartment.

Also, the refrigerator may further include a water tank compartment which is formed between the freezing compartment and the refrigerating compartment inside the body.

The water tank compartment may have a water filter purifying water and a water tank storing water.

The refrigerator may further include a third intermediate insulation wall which insulates the water tank compartment from the ice making compartment.

Also, the refrigerator may further include a dispenser which dispenses ice in the ice making compartment and water in the water tank compartment and which has a dispensing space disposed in front of the water tank compartment The refrigerator may further include a fourth intermediate insulation wall which insulates the water tank compartment from the dispensing space.

In accordance with another aspect of the present disclosure, a refrigerator includes a body; a freezing compartment formed inside the body and having an open front portion; a refrigerating compartment formed inside the body and having an open front portion; an ice making compartment formed between the freezing compartment and the refrigerating compartment inside the body and having an open front portion; a freezing compartment door closing the open front portion of the freezing compartment; a refrigerating compartment door closing the open front portion of the refrigerating compartment; and a front insulation wall which covers the open front portion of the ice making compartment.

The front insulation wall may have an opening, and the opening may be closed by an ice bucket which is slidingly inserted into or drawn from the ice making compartment.

The ice bucket may include a storage space to store ice, a crushing space to crush ice, an auger to move the ice in the storage space into the crushing space, and an insulation cover with a corresponding size to the opening to cover the opening.

In accordance with another aspect of the present disclosure, a refrigerator includes a body; a freezing compartment formed inside the body; a refrigerating compartment formed inside the body; an ice making compartment formed between the freezing compartment and the refrigerating compartment inside the body; a first intermediate insulation wall insulating the ice making compartment from the freezing compartment; and a second intermediate insulation wall insulating the ice making compartment from the refrigerating compartment.

According to the present disclosure, an ice making efficiency of a side by side type refrigerator can be enhanced.

Also, an ice bucket can be inserted into or drawn from an ice making compartment without opening a door. Therefore, an ice bucket can be easily inserted or drawn, and it is possible to reduce energy consumption.

Further, a distance between a water tank and a dispenser can be shortened so that a water supplying pipe can be simplified and the reliability of a water supplying system can be enhanced.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
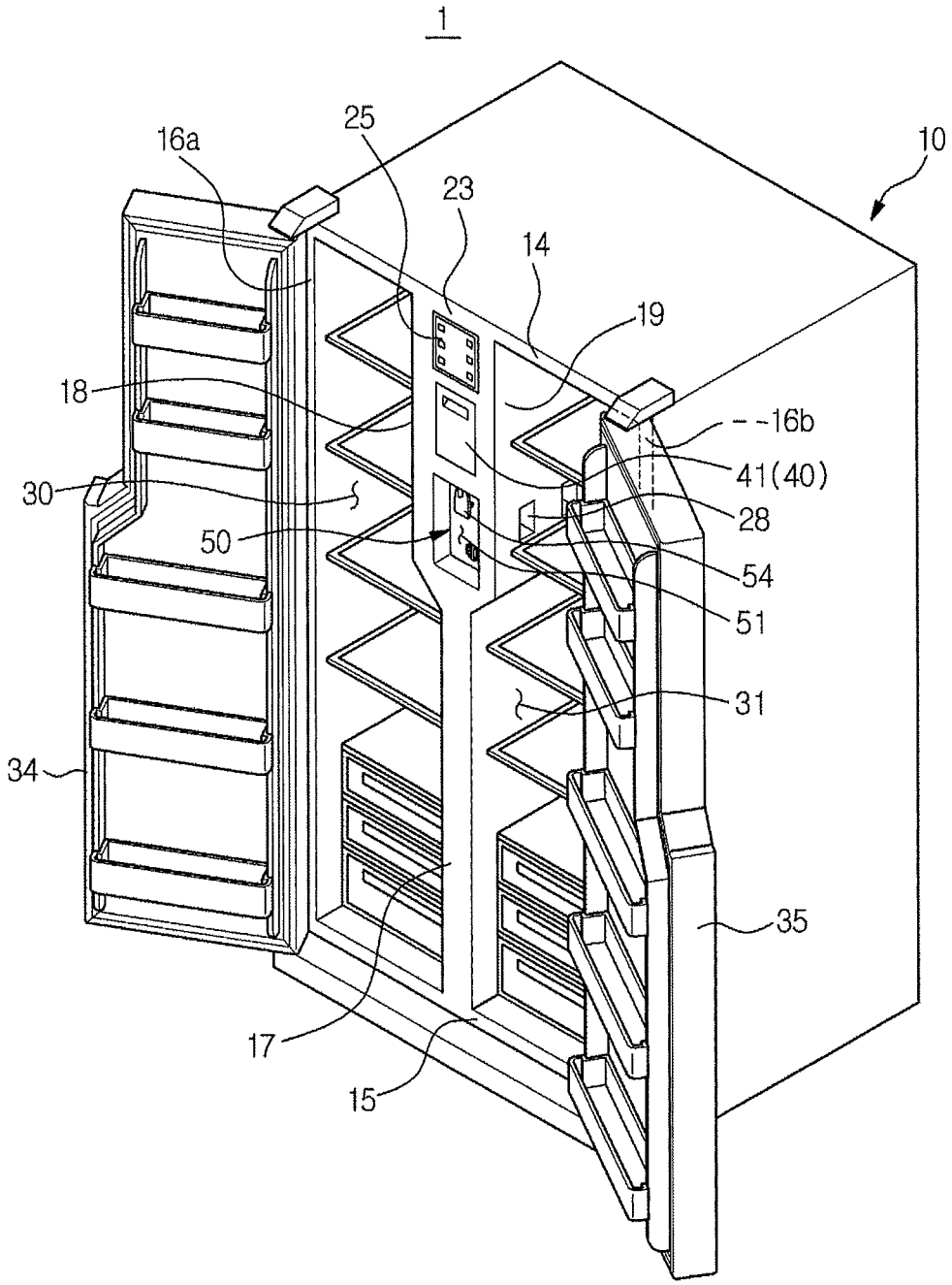
FIG. 1 is a perspective view of an appearance of a refrigerator according to an embodiment of the present disclosure.

Reference will now be made in detail to embodiments of the present disclosure, examples of which are illustrated in the accompanying drawings, wherein like reference numerals refer to like elements throughout. Also, although the present disclosure illustrates a side by side type refrigerator as an example, the present disclosure may be applied to various types of refrigerators such as a French-door refrigerator, a refrigerator having a top or bottom mounted freezer, and so on.

Figure 2:
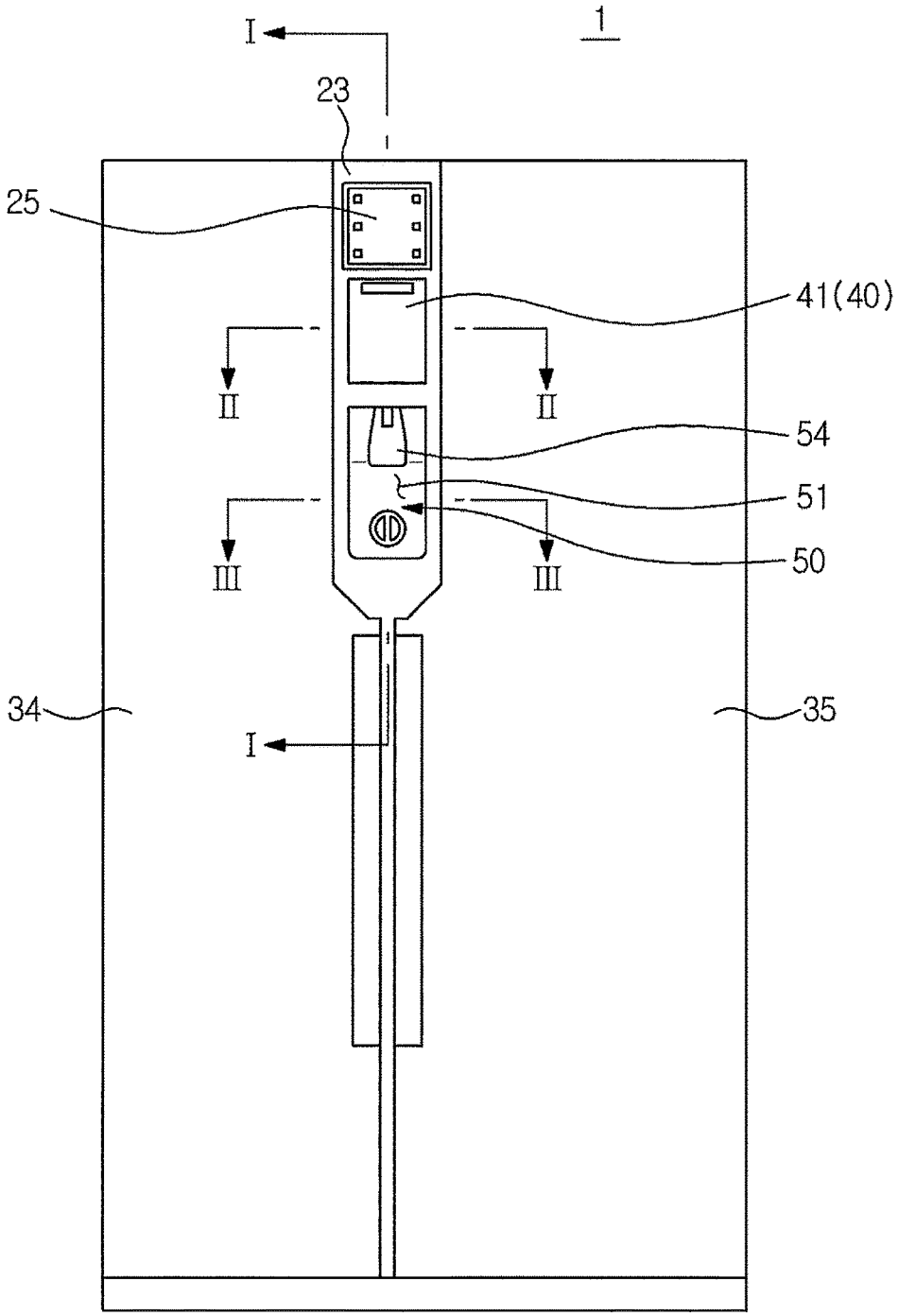
FIG. 2 is a front view of an appearance of a refrigerator of FIG. 1.
Figure 3:
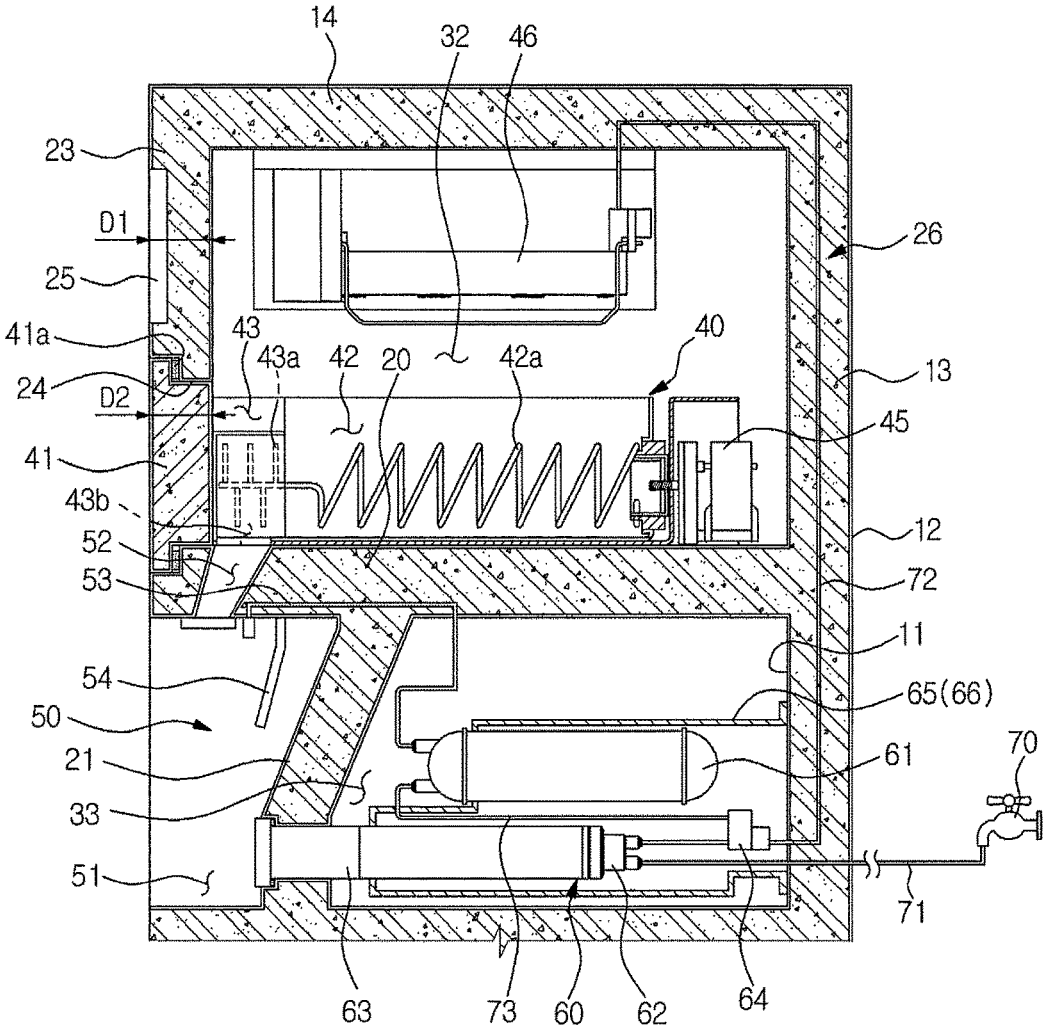
FIG. 3 is a cross-sectional view of a refrigerator along with I-I line of FIG. 2.
Figure 4:
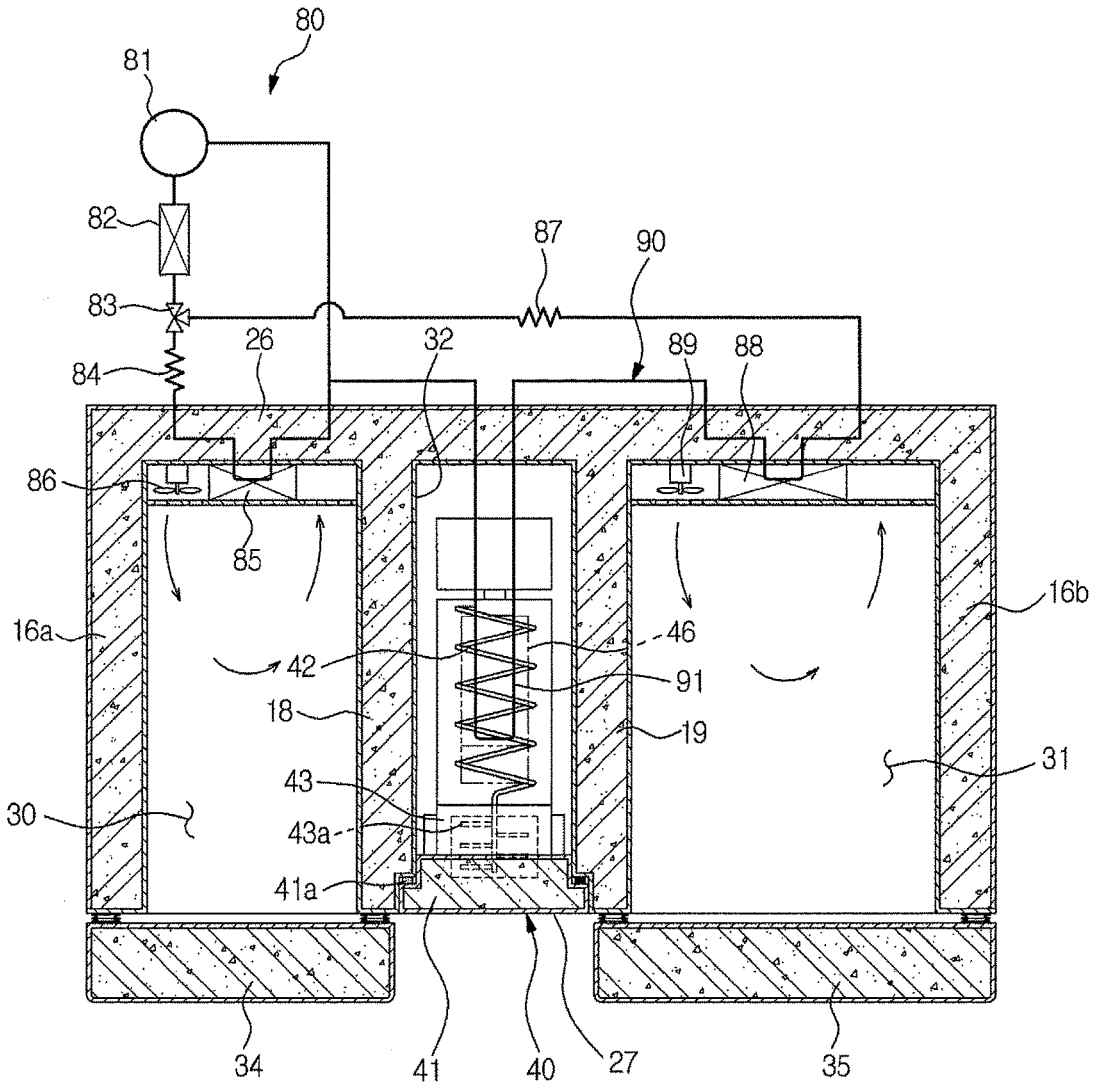
FIG. 4 is a cross-sectional view of a refrigerator along with II-II line of FIG. 2.
Figure 5:
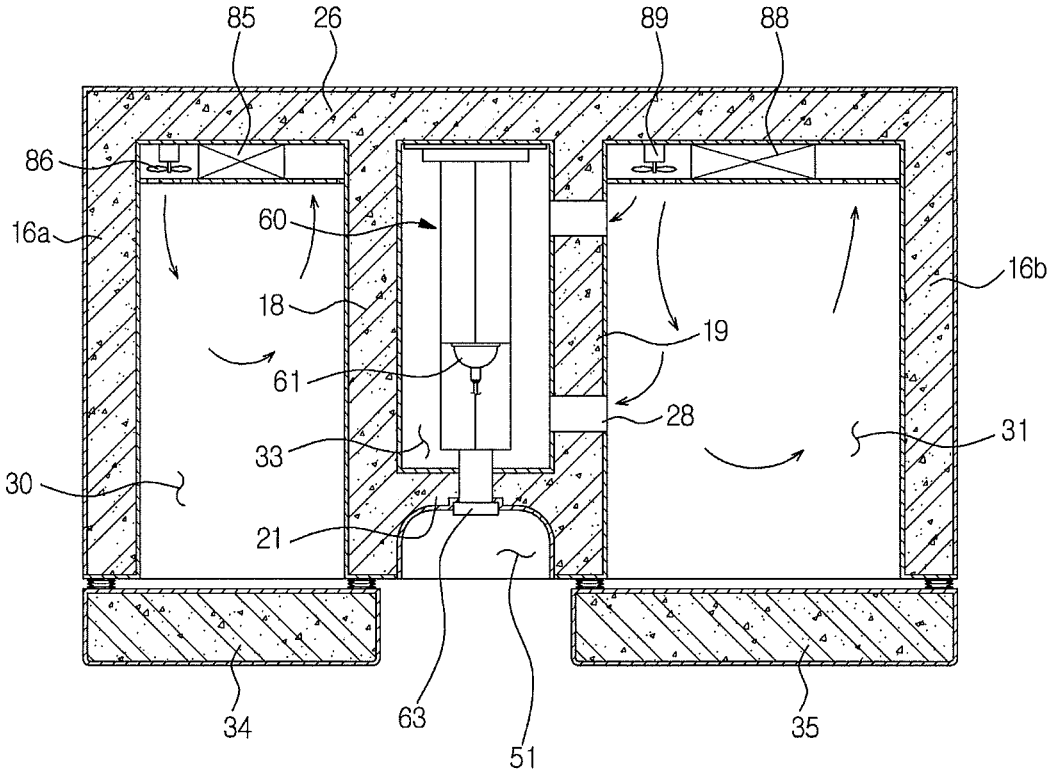
FIG. 5 is a cross-sectional view of a refrigerator along with III-III line of FIG. 2.
Figure 6:
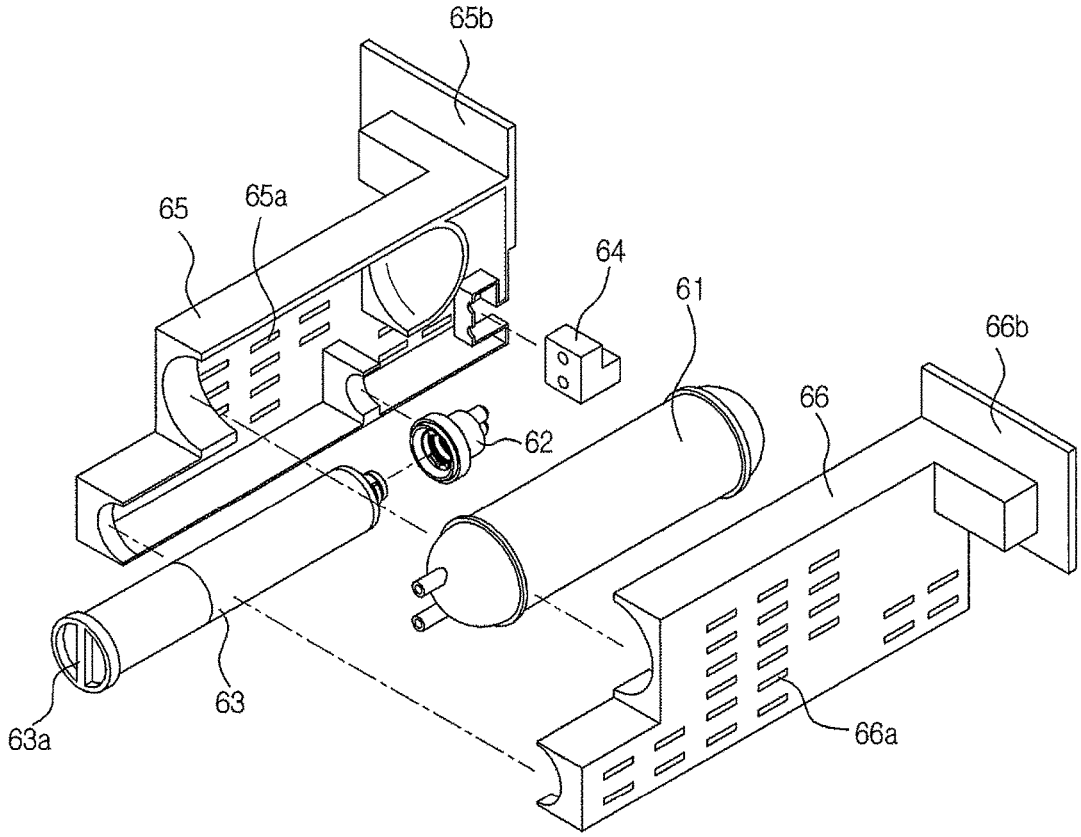
FIG. 6 is a view illustrating a water supplying assembly of a refrigerator of FIG. 1.

FIG. 1 is a perspective view of an appearance of a refrigerator according to an embodiment of the present disclosure, and FIG. 2 is a front view of an appearance of a refrigerator of FIG. 1. FIG. 3 is a cross-sectional view of a refrigerator along with I-I line of FIG. 2, and FIG. 4 is a cross-sectional view of a refrigerator along with II-II line of FIG. 2, FIG. 5 is a cross-sectional view of a refrigerator along with III-III line of FIG. 2. FIG. 6 is a view illustrating a water supplying assembly of a refrigerator of FIG. 1.

Referring to FIG. 1 to FIG. 6, a refrigerator 1 includes a body 10 having compartments 30, 31, 32, and 33, and a cooling energy supplying device 80 (FIG. 4) which supplies a cooling energy to the compartment 30, 31, 32, and 33.

The compartments 30, 31, 32, and 33 include a freezing compartment 30 which freezes and stores foods, a refrigerating compartment 31 which refrigerates and stores foods, an ice making compartment 32 which makes ice, and a water tank compartment 33 which accommodates a water tank 61.

The freezing compartment 30 is disposed on a left side inside the body 10, and the refrigerating compartment 31 is disposed on a right side inside the body 10. The position of the freezing compartment 30 and the refrigerating compartment 31 may be changed with each other. The ice making compartment 32 is formed between the freezing compartment 30 and the refrigerating compartment 31 inside the body 10. The water tank compartment 33 is formed below the ice making compartment 32 between the freezing compartment 30 and the refrigerating compartment 31 inside the body 10.

The freezing compartment 30 is formed with its front portion open, and the open front portion of the freezing compartment 30 can be closed by a freezing compartment door 34 which is rotatably connected to the body 10. The refrigerating compartment 31 is formed with its front portion open, and the open front portion of the refrigerating compartment 31 can be closed by a refrigerating compartment door 35 which is rotatably connected to the body 10.

The ice making compartment 32 is formed with all sides insulated except a front open portion 24 (FIG. 3) through which an ice bucket 40 can be accessible, and the front open portion 24 can be closed by a insulation cover 41 of the ice bucket 40.

The freezing compartment door 34 and the refrigerating compartment door 35 is configured not to cover the ice bucket 40 when the doors 34 and 35 are in a closed state so that the ice bucket 40 can be inserted into or drawn from the ice making compartment 32 without opening the freezing compartment door 34 and the refrigerating compartment door 35.

Meanwhile, the refrigerator 1 may have a dispenser 50 which dispenses water or ice. The dispenser 50 includes a dispensing space 51 where water or ice can be obtained by putting a container such as a cup etc., an operation lever 54 which operates the dispenser 50, a purified water discharging pipe 53 which connects the water tank 61 and the dispensing space 51, an ice guide channel 52 which connects the ice bucket 40 and the dispensing space 51. The dispensing space 51 may be positioned in front of the water tank compartment 33 below the ice making compartment 32.

Meanwhile, the body 10 may include an inner case 11 (FIG. 3), an outer case 12 (FIG. 3) which is combined to an outside of the inner case 11 so as to form an appearance of a refrigerator, and an insulation material 13 (FIG. 3) disposed between the inner case 11 and the outer case 12. The inner case 11 may be made of a resin material, and the outer case 12 may be made of a metal material. The insulation material 13 may be urethane foam.

The body 10 may have an upper insulation wall 14, a bottom insulation wall 15, two side insulation walls **16*a*** and 16*b*, a rear insulation wall 26, a plurality of intermediate insulation walls 17, 18, 19, 20, and 21, and a front insulation wall 23 in order to insulate the compartments 30, 31, 32, and 33.

The upper insulation wall 14, the bottom insulation wall 15, the two side insulation walls 16*a* and 16*b*, and the rear insulation wall 26 may form the compartments 30, 31, 32, and 33 in a shape of a box with its front portion open.

The plurality of intermediate insulation walls 17, 18, 19, 20, and 21 are disposed inside the box and includes a main intermediate insulation wall 17, a first intermediate insulation wall 18, a second intermediate insulation wall 19, a third intermediate insulation wall 20 (FIG. 3), and a fourth intermediate insulation wall 21 (FIG. 3).

The main intermediate insulation wall 17 insulates and separates the freezing compartment 30 from the refrigerating compartment 31, and extends upwardly from the bottom insulation wall 15. The main intermediate insulation wall 17 may extend vertically.

The first intermediate insulation wall 18 insulates and separates the ice making compartment 32 from the freezing compartment 30, and insulates and separates the water tank compartment 33 from the freezing compartment 30 at the same time. The first intermediate insulation wall 18 may be formed to connect the main intermediate insulation wall 17 and the upper insulation wall 14.

The second intermediate insulation wall 19 insulates and separates the ice making compartment 32 from the refrigerating compartment 31, and insulates and separates the water tank compartment 33 from the refrigerating compartment 31 at the same time. The second intermediate insulation wall 19 may be formed to connect the main intermediate insulation wall 17 and the upper insulation wall 14. A cooling air supplying channel 28 (FIG. 5) may be provided in order to supply the cooling air in the refrigerating compartment 31 to the water tank compartment 33 in a portion of the second intermediate insulation wall 19 which separates the water tank compartment 33 from the refrigerating compartment 31.

The third intermediate insulation wall 20 insulates and separates the ice making compartment 32 from the water tank compartment 33, and extends forwardly from the rear insulation wall 26. The third intermediate insulation wall 20 may extend horizontally. The fourth intermediate insulation wall 21 insulates and separates the water tank compartment 33 from the dispensing space 51 of the dispenser 50, and may extend downwardly from the third intermediate insulation wall 20.

Finally, the front insulation wall 23 insulates a front portion of the ice making compartment 32 and may be disposed between a front portion of the first intermediate insulation wall 18 and a front portion of the second intermediate insulation wall 19. A front opening 24 may be provided in the front insulation wall 23. As mentioned before, the ice bucket 40 can be inserted into or drawn from the ice making compartment 32 through the front opening 24, and the front opening 24 can be closed by the insulation cover 41 of the ice bucket 40. Further, a control panel 25 may be provided in a front surface of the front insulation wall 23, and the control panel 25 can display operation information of the refrigerator 1 or receive operation commands. Although the front insulation wall 23 is illustrated as having its front surface positioned in a same plane with a front portion of the first intermediate insulation wall 18 and a front portion of the second intermediate insulation wall 19, the front insulation wall 23 may protrude forwardly to have its front surface positioned in a same plane with a front surface of the refrigerator compartment door 34 and a front surface of the freezing compartment door 35.

The ice making compartment 32 is not covered by the freezing compartment door 34 and the refrigerating compartment door 35 but covered only by the front insulation wall 23 and the insulation cover 41 of the ice bucket 40 so that the front insulation wall 23 and the insulation cover 41 of the ice bucket 40 should have predetermined thickness D1 and D2 sufficient to insulate the ice making compartment 32. Also, it is preferable to make the thickness D1 of the front insulation wall 23 and the thickness D2 of the insulation cover 41 of the ice bucket 40 consistent with each other.

Thus, the ice making compartment 32 is able to be insulated by the upper insulation wall 14, the rear insulation wall 26, the first intermediate insulation wall 18, the second intermediate insulation wall 19, the third intermediate insulation wall 20, and the front insulation wall 23.

Inside the ice making compartment 32, there may be an ice maker 46 generating ice, the ice bucket 40 storing the ice generated from the ice maker 46, and an auger motor 45 driving the ice bucket 40.

The ice bucket 40 may include the insulation cover 41 as mentioned before, a storage space 42 to store ice, and a crushing space 43 to crush ice, an auger 42*a* to move ice in the storage space 42 into the crushing space 43.

The insulation cover 41 may have a sealing member 41 a to seal the front insulation wall 23. An ice crushing blade 43*a* and discharging port 43*b* to discharge ice to an outside of the ice bucket 40 may be provided in the crushing space 43.

The ice generated in the ice maker 46 can fall into the storage space 42 after being separated from the ice maker 46 through an ice separating device such as an ejector (not shown) and/or an ice separating heater (not shown) etc. The ice in the storage space 42 may be moved forwardly to the crushing space 43 by the rotation of the auger 42*a*, and then be crushed into shattered ice in the crushing space 43. Shattered ice crushed in the crushing space 43 or unshattered ice cubes may be discharged to the dispensing space 51 through the discharging port 43*b* and the ice guide channel 52.

Meanwhile, a water supplying assembly 60 may be provided in the water tank compartment 33 in order to supply water to the ice maker 46 and the dispenser 50.

As shown in FIG. 3 and FIG. 6, the water supplying assembly 60 may have a water tank 61 which stores water supplied from outside water source 70 such as a water pipe tap etc., a water filter 60 which purifies the water which will be supplied to the water tank 61, a water path switching valve 64 which directs water having passed through the water filter 60 either to the water tank 61 or to the ice maker 46, and cases 65 and 66 which accommodates the above mentioned components.

As such configuration, the water supplying assembly 60 can be provided as a module of which all components are accommodated inside the cases 65 and 66. Each case 65 and 66 may have at least one air slot 65*a* and 66*a* through which a cooling air flows in and a connection portion 65*b* and 66*b* with which the water supplying assembly 60 can be mounted to the inner case 11 inside the water tank compartment 33. However, the shape of the connection portion 65*b* and 66*b* according to the present disclosure is illustrated as an example, and therefore is not limited to this disclosure, and can be anything as long as it is able to connect the water supplying assembly 60 to the water tank compartment 33.

Meanwhile, the water supplying assembly 60 may have a connector 62 into which the water filter 63 is detachably mounted. Therefore, the water filter 63 purifies water in connection with the connector 62 in a normal operation state, and can be detached from the connector 62 in cases of replacement and cleaning. Further, a knob 63*b* which can be manipulated by a user's hand may be provided with the water filter 63 to facilitate detachment of the water filter 63 from the connector 62, and the knob 63*b* may be exposed to a front portion of the water tank compartment 33 through an opening in the further intermediate insulation wall 21 as shown in FIG. 3. Therefore, a user can easily draw the water filter 63 by grabbing the knob 63*b*.

With above mentioned configuration, the water in the outside water source 70 can be supplied to the water filter 63 through a first water pipe 71, and then the water purified in the water filter 63 may be supplied to the ice maker 46 through a second water pipe 72 or may be supplied to the water tank 61 through a third water pipe 73. The water in the water tank 61 may be cooled down to an appropriate temperature to be dispensed and then be stored in the water tank 61. The cooled water in the water tank 61 may be dispensed to the dispensing space 51 through the purified water discharging pipe 53.

In particularly, since the dispensing space 51 of the dispenser 50 is provided in front of the water tank compartment 33, the purified water discharging pipe 53 which connects the water tank 61 and the dispensing space 51 can be shortened, and the connecting structure of the purified water discharging pipe 53 can be simplified.

Meanwhile, in case a refrigerator may not have a dispenser unlike this disclosure, the water tank compartment 33 may be used in other use such as a wine storing compartment or a rapid cooling compartment etc.

Referring to FIG. 4 and FIG. 5, the cooling energy supplying device 80 of the refrigerator 1 according to the embodiment of the present disclosure will be described next.

The cooling energy supplying device 80 may include a compressor 81 which compresses a refrigerant, a condenser 82 which condenses the compressed refrigerant, capillary tubes 84 and 87 which expand the refrigerant, evaporators 85 and 88 which evaporate the refrigerant so as to make a cooling air, blower fans 86 and 89 which circulate the cooling air, and a refrigerant pipe 90 which guides the refrigerant. The compressor 81 and the condenser 82 may be provided in a machinery room (not shown) disposed in a rear bottom portion of the body 10.

Two cooling cycles may be made by the cooling energy supplying device 80. One cooling cycle can supply a cooling energy to the freezing compartment 30, and the other cooling cycle can supply a cooling energy to the refrigerating compartment 31 and the ice making compartment 32.

For this purpose, each evaporator 85 and 88 can be installed in the freezing compartment 30 and the refrigerating compartment 31 respectively, and the refrigerant pipe 90 passing through the evaporator 88 of the refrigerating compartment 31 may pass through the ice making compartment 32. In other words, the ice making compartment 32 of the refrigerator 1 according to the present disclosure can receive a cooling energy directly from the refrigerant pipe 91 which is disposed in the ice making compartment 32.

The refrigerant pipe 91 which is disposed in the ice making compartment 32 may be designated as an ice making compartment refrigerant pipe 91, and the ice making compartment refrigerant pipe 91 may contact the ice maker 46. Therefore, the ice maker 46 generates ice rapidly while it functions as an evaporator.

According to the present disclosure described before, as a side by side type refrigerator which has the freezing compartment 30 and the refrigerating compartment 31 on the left and right sides inside the body respectively and of which the freezing compartment 30 and the refrigerating compartment 31 can be closed by a pair of rotatable doors 34 and 35, a separate ice making compartment 32 insulated from the freezing compartment 30 and the refrigerating compartment 31 is provided between the freezing compartment 30 and the refrigerating compartment 31, and a portion of a refrigerant pipe is inserted into the ice making compartment 32 so as to generate ice fast by directly cooling the ice maker 46.

Further, since the ice making compartment 32 is neither opened nor closed by the freezing compartment door 34 and the refrigerating compartment door 35, there is no need to open the freezing compartment door 34 and the refrigerating compartment door 35 when the ice bucket 40 is extracted. Therefore, it is possible to reduce energy consumption by preventing a leakage of a cooling air which is caused by opening the freezing compartment door 34 and the refrigerating compartment door 35.

Meanwhile, in addition to the embodiment described above, it is possible that the ice making compartment 32 may be configured to have indirect cooling instead of direct cooling. Specifically, it is possible to cool down the ice making compartment 32 by providing a separate cooling air delivering duct which delivers a cooling air in the freezing compartment 30 to the ice making compartment 32 instead of inserting a refrigerant pipe into the ice making compartment 32. Further, it is also possible to communicate the freezing compartment 30 and the ice making compartment 32 by eliminating the first intermediate insulation wall 18.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a body;

a freezing compartment formed inside the body and having an open front portion;

a refrigerating compartment formed inside the body and having an open front portion;

a freezing compartment door rotatably connected to the body and closing the open front portion of the freezing compartment;

a refrigerating compartment door rotatably connected to the body and closing the open front portion of the refrigerating compartment;

an ice making compartment formed inside the body and accessible without opening either of the freezing compartment door and the refrigerating compartment door;

a front insulation wall formed in front of the ice making compartment and forming a front surface of the refrigerator, the front insulation wall including an opening; and a dispenser to dispense water or ice, wherein the ice making compartment comprises an ice maker to generate ice, an auger motor, and an ice bucket to store the ice generated by the ice maker, the ice bucket including an insulation cover formed on a front surface of the ice bucket which closes the opening, a storage space to store ice, a crushing space to crush ice, and an auger to move the ice in the storage space into the crushing space, wherein the ice making compartment is formed between and separately from the freezing compartment and the refrigerating compartment, wherein the ice making compartment is not covered by either of the refrigerating compartment door and the freezing compartment door, and wherein the ice bucket is configured to be directly inserted into or drawn from the opening of the front insulation wall without opening a door.

2. The refrigerator of claim 1, wherein the refrigerator further comprises a first intermediate insulation wall which insulates the ice making compartment from the freezing compartment and a second intermediate insulation wall which insulates the ice making compartment from the refrigerating compartment.

3. The refrigerator of claim 2, wherein the refrigerator further comprises a water tank compartment which is formed inside the body and which is accessible without opening either of the freezing compartment door and the refrigerating compartment door.

4. The refrigerator of claim 3, wherein the water tank compartment has a water filter purifying water and a water tank storing water.

5. The refrigerator of claim 4, wherein the refrigerator further comprises a third intermediate insulation wall which insulates the water tank compartment from the ice making compartment.

6. The refrigerator of claim 5, wherein the dispenser dispenses ice from the ice making compartment and water in the water tank, and the dispenser includes a dispensing space disposed in front of the water tank compartment.

7. The refrigerator of claim 6, wherein the refrigerator further comprises a fourth intermediate insulation wall which insulates the water tank compartment from the dispensing space.

8. The refrigerator of claim 6, wherein the fourth intermediate insulation wall has an opening through which a knob of the water filter is exposed outside the water tank compartment.

9. The refrigerator of claim 1, wherein a thickness of the insulation cover corresponds to a thickness of the front insulation wall.

10. The refrigerator of claim 1, wherein a front surface of the front insulation wall is on a same plane as a front surface of the freezing compartment door or the refrigerating compartment door.

11. The refrigerator of claim 1, wherein a front surface of the front insulation wall is provided with a control panel which displays operation information of the refrigerator and receives operation commands of the refrigerator.

12. The refrigerator of claim 1, wherein the refrigerator further comprises a cooling energy supplying device having a compressor, a condenser, a capillary tube, an evaporator, and a refrigerant pipe, and at least a portion of the refrigerant pipe is inserted into the inside of the ice making compartment to directly cool the ice making compartment.

* * * * *